US008147601B2

(12) United States Patent
Feldstein et al.

(10) Patent No.: US 8,147,601 B2
(45) **Date of Patent: *Apr. 3, 2012**

(54) COMPOSITE ELECTROLESS PLATING

(75) Inventors: Michael Feldstein, Princeton, NJ (US); Thomas Stephen Lancsek, Trenton, NJ (US); Jijeesh Jose Thottathil, Mercerville, NJ (US)

(73) Assignee: Surface Technology, Inc., Robbinsville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/962,034

(22) Filed: Dec. 7, 2010

(65) Prior Publication Data

US 2011/0077338 A1 Mar. 31, 2011

Related U.S. Application Data

(63) Continuation of application No. 12/235,682, filed on Sep. 23, 2008, which is a continuation of application No. 12/212,898, filed on Sep. 18, 2008, now abandoned, which is a continuation-in-part of application No. 11/123,983, filed on May 6, 2005, now abandoned.

(51) Int. Cl.
*C23C 18/31* (2006.01)
*C23C 18/34* (2006.01)
*C23C 18/40* (2006.01)

(52) U.S. Cl. ..... 106/1.22; 106/1.23; 106/1.25; 106/1.26; 106/1.27

(58) Field of Classification Search ..... 106/1.22, 106/1.25, 1.23, 1.26, 1.27
See application file for complete search history.

(56) References Cited

U.S. PATENT DOCUMENTS

| | | | | |
|---|---|---|---|---|
| 3,617,363 | A | 11/1971 | Metzger et al. | |
| 3,644,183 | A | 2/1972 | Odekerken | |
| 3,677,907 | A * | 7/1972 | Brown et al. | 106/1.22 |
| 3,723,078 | A | 3/1973 | Parker | |
| 3,753,667 | A * | 8/1973 | Metzger et al. | 428/639 |
| 3,787,294 | A | 1/1974 | Kurosaki et al. | |
| 4,098,654 | A | 7/1978 | Helle et al. | |
| 4,302,374 | A * | 11/1981 | Helle et al. | 524/168 |
| 4,358,922 | A | 11/1982 | Feldstein | |
| 4,358,923 | A | 11/1982 | Feldstein | |
| 4,547,407 | A | 10/1985 | Spencer | |
| 4,677,817 | A | 7/1987 | Kanai | |
| 4,698,958 | A | 10/1987 | Nakano et al. | |
| 4,830,889 | A * | 5/1989 | Henry et al. | 427/438 |
| 4,997,686 | A | 3/1991 | Feldstein et al. | |
| RE33,767 | E | 12/1991 | Christini | |
| 5,145,517 | A | 9/1992 | Feldstein et al. | |
| 5,221,328 | A | 6/1993 | Bishop et al. | |
| 5,300,330 | A | 4/1994 | Feldstein et al. | |
| 5,306,334 | A | 4/1994 | Martyak et al. | |
| 5,480,477 | A * | 1/1996 | Feldstein et al. | 106/1.27 |
| 5,580,375 | A * | 12/1996 | Feldstein et al. | 106/1.25 |
| 5,718,745 | A * | 2/1998 | Itoh et al. | 106/1.22 |
| 5,721,055 | A | 2/1998 | Feldstein | |
| 5,863,616 | A | 1/1999 | Feldstein et al. | |
| 6,156,390 | A * | 12/2000 | Henry et al. | 427/438 |
| 6,273,943 | B1 * | 8/2001 | Chiba et al. | 106/1.22 |
| 6,306,466 | B1 * | 10/2001 | Feldstein et al. | 427/437 |
| 6,309,583 | B1 | 10/2001 | Feldstein | |
| 6,319,308 | B1 | 11/2001 | McComas | |
| 6,506,509 | B1 | 1/2003 | Feldstein et al. | |
| 6,824,597 | B2 | 11/2004 | Heber et al. | |
| 6,837,923 | B2 * | 1/2005 | Crotty et al. | 106/1.22 |
| 6,911,269 | B2 | 6/2005 | Hollander et al. | |
| 7,744,685 | B2 * | 6/2010 | Lancsek et al. | 106/1.22 |
| 2009/0017317 | A1 * | 1/2009 | Lancsek et al. | 428/457 |

OTHER PUBLICATIONS

Pearlstein, F., Modern Electroplating, Ch. 31, 3rd Ed., John Wiley & Sons, Inc. (1974), New York.

David E. Crotty, Lead and Cadium Free Electroless Nickel Processes for the 21st Century, SFIC SUR/FIN 2005 Proceedings, pp. 147-161 (Jun. 14, 2005).

G. Mallory et al., Electroless Plating Fundamentals and Applications, Chapter 11, American Electroplaters and Surface Finishers Society, Orlando, Florida, 1990.

Douglas C. Vogel, Innovative Electroless Nickel Technology that meets the requirements for End of Vehicle Life Directive (ELVD), ROHS, and WEEE, Excerpt of Conference Proceedings of the 20061nternational Conference on Green Surface Finishing Technology Conference Jul. 18, 2006 (Symposium).

Rich Bellemare, RoHS and ELV Compliant Electroless Nickel, Products Finishing Magazine, vol. 70, No. 1, Oct. 2005, pp. 50-55.

Duncan Beckett and Greg Terrell, MacDermid Inc., User Experience with an Organically Stabilized Electroless Nickel Process, www.pfonline.com, pp. 19-22, Apr. 2009.

* cited by examiner

*Primary Examiner* — Helene Klemanski
(74) *Attorney, Agent, or Firm* — Gottlieb Rackman & Reisman,PC

(57) ABSTRACT

This invention is directed to a process for electrolessly metallizing an article, as well as to a plating bath and the subsequent plated substrate. The process comprises contacting the surface of an article with an electroless metallizing bath which may be essentially free of toxic and/or heavy metals.

20 Claims, No Drawings

COMPOSITE ELECTROLESS PLATING

The present application is a continuation of U.S. application Ser. No. 12/235,682, filed on Sep. 23, 2008, presently pending, which is a continuation of U.S. application Ser. No. 12/212,898, filed on Sep. 18, 2008, now abandoned, which is a continuation-in-part of U.S. application Ser. No. 11/123, 983, filed on May 6, 2005, now abandoned, which is incorporated herein by reference.

BACKGROUND OF THE INVENTION

The present invention relates in general to composite electroless plating, and more particularly, to a process of composite electroless plating without the intentional introduction of certain objectionable materials such as toxic and/or heavy metals, articles resulting from the process, and plating baths used in the process.

The electroless plating of articles or substrates with a composite coating containing finely dispersed particulate matter is well documented.

Electroless plating generally involves the deposition of metal alloys by chemical or electrochemical reduction of aqueous metal ions without introducing an electrical current to activate the ionization process. Through such deposition, the process of electrolessly metallizing a desired metal coating over an article or substrate is achieved.

The fundamentals of composite electroless plating are documented in a text entitled "Electroless Plating Fundamentals and Applications," edited by G. Mallory and J. B. Hajdu, Chapter 11, published by American Electroplaters and Surface Finishers Society (1990), which is herein incorporated by reference.

As opposed to conventional electroless plating methods, in composite electroless plating, insoluble or sparingly soluble particulate matter is intentionally introduced into a bath solution for subsequent co-deposition onto a substrate or article as a coating.

The evolution of composite electroless plating dates back to U.S. Pat. No. 3,644,183 (Oderkerken), in which a structure of composite electroless plating with finely divided aluminum oxide was interposed between electrodeposited layers to improve the corrosion resistance. Thereafter, U.S. Pat. Nos. 3,617,363 and 3,753,667 (Metzger et al.) extended the Oderkerken work to a great variety of particles and miscellaneous electroless plating baths. Thereafter, Christini et al., in U.S. Pat. No. RE 33,767, further extended the composite electroless plating technique to include the co-deposition of diamond particles. All of the foregoing references are herein incorporated by reference.

The co-deposition of particles in composite electroless plating can dramatically enhance existing characteristics and even add entirely new properties. These capabilities have made composite electroless coatings advantageous for a variety of reasons including, but not limited to, increased utility in conditions requiring less wear and lower friction; facilitating the use of new substrate materials such as titanium, aluminum, lower cost steel alloys, ceramics, and plastics; allowing higher productivity of equipment with greater speeds, less wear, and less maintenance related downtime; and replacing environmentally problematic coatings such as electroplated chromium or nickel. In this last regards, for example, composite electroless coatings with nickel even provide an additional environmental advantage over conventional electroless nickel coatings, which do not include particulate matter, in that the particles within composite electroless nickel coatings reduce the amount of nickel alloy used. Specifically, composite electroless nickel plating reduces the amount of nickel introduced to the environment by a percent equal to the volume percent of the particulate matter within the composite electroless nickel coating.

In addition, composite electroless coatings are regenerative, meaning that their properties are maintained even as portions of the coating are removed during use. This feature results from the uniform manner with which the particles are dispersed throughout the entire plated layer.

However, known composite electroless plating processes suffer from a number of disadvantages. In particular, composite electroless plating baths are inherently unstable and prone to decomposition. To overcome this instability, the standard approach is the use of toxic and/or heavy metals in the plating baths. This incorporation of toxic and/or heavy metals into the plating baths presents multiple challenges. The toxic and/or heavy metals must be added in a sufficient amount to prevent the decomposition of the plating bath, but an increased concentration beyond the necessary level required to prevent the decomposition results in cessation or reduction of the plating rate.

In addition, any materials introduced into the plating bath is likely to be included in the plating. Because regulations directed toward environmental protection preclude disposal of toxic and/or heavy metals, and such regulation has been expanding, a need exists for a plating process which combines the positive features of composite electroless plating without the use of environmentally and regulatorally unfriendly materials.

Accordingly, there is still an unsolved need for further improvements in composite electroless plating methods.

SUMMARY OF THE INVENTION

All composite electroless plating techniques known in the art, including the art referenced above, incorporate the intentional addition of toxic and/or heavy metals in the plating process for increased stability of the plating process. Specifically, these toxic and/or heavy metals, generally include lead, mercury, cadmium, and/or thallium, which are utilized as stabilizers to prevent the decomposition of plating baths. However, the use of such stabilizers has drawbacks. As explained in U.S. Pat. No. 6,306,466, increased concentration of heavy metals in electroless composite plating baths above a minimum level necessary for stabilization results in a diminished plating rate. In addition, use of elements viewed as environmentally toxic are undesirable due to regulations regarding disposal of products containing these elements.

In addition, the inclusion of insoluble particulate matter in composite electroless baths introduces additional instability. To overcome the extra instability due to the addition of insoluble particulate matter to the bath, U.S. Pat. No. 6,306, 466 teaches the use of particulate matter stabilizers (PMS), which are believed to isolate the finely divided particulate matter, thereby maintaining the matter's "inertness." Also, properly selected particulate matter stabilizers tend to modify the charge on the particulate matter to maintain the matter's inertness. The precise addition of particulate matter stabilizers contributes to addressing the instability issues directly related to the addition of insoluble particulate matter to the plating baths, as shown in U.S. Pat. Nos. 4,997,686, 5,145, 517, 5,300,330, 5,863,616 and 6,306,466.

Accordingly, an object of the present invention is to provide plating baths, a process of composite electroless plating without the intentional introduction of certain objectionable materials such as toxic and/or heavy metals, and a coating for articles whereby the coating is a result of the process.

In this regard, increasingly stringent rules and regulations that restrict or prohibit the use of certain materials, such as the End-Of-Life Vehicle (ELV) Regulations and Restriction of Certain Hazardous Substances (RoHS), means that the present invention has an extra added benefit. These regulations are designed to reduce the presence of certain materials with health and/or environmentally problematic qualities in articles. Because the present Applicants have found that particulate matter stabilizers and other materials can stabilize the plating bath as well and overcome the instability from adding insoluble or sparingly soluble particulate matter, use of the present invention complies with such regulations because it does away with the need for potentially costly and certainly environmentally regulated materials in composite electroless plating, which thereby avoids the incorporation of such hazardous materials in the articles plated in such baths.

In accordance with embodiments of the present invention, there is described a process of electrolessly metallizing an article to provide on its surface a metal coating containing particulate matter, in which the electroless metallizing bath is essentially free of toxic and/or heavy metals.

In accordance with other embodiments of the present invention, there is described an electroless metallizing or plating bath for use in a process of electrolessly metallizing an article to provide on its surface a metal coating with particulate matter, in which the electroless metallizing or plating bath is essentially free of toxic and/or heavy metals.

In accordance with other embodiments of the present invention, there is described an article with a coating, in which the coating contains an electroless metal and particulate matter, and is essentially free of toxic and/or heavy metals.

DETAILED DESCRIPTION

In describing the preferred embodiments of the present invention, specific terminology will be resorted to for the sake of clarity. However, the invention is not intended to be limited to the specific terms so selected and is to be understood that each specific term includes all technical equivalence which operate in a similar manner to accomplish a similar purpose.

In the practice of the present invention, an electroless metallizing bath is formulated by adding together a metal salt, a reducing agent, additional ingredients, and one or more stabilizers in an aqueous or otherwise liquid solution. The typical electroless metallizing bath includes one or more bath stabilizers that are usually in the form of toxic and/or heavy metals, However, the bath of the present invention may be essentially free of toxic metals: heavy metals, or both. Any metal-containing bath stabilizer used in the present invention preferably includes compounds with one or more components selected from a group consisting of antimony, bismuth, copper, manganese, molybdenum, and tungsten.

The metal portion of the metal salt may be selected from suitable metals capable of being deposited through composite electroless plating. Such metals include, without limitation, nickel, boron, cobalt, copper, gold, palladium, iron, other transition metals, mixtures thereof, and any of the metals deposited by the autocatalytic process described in Pearlstein, F., "Modern Electroplating", Ch. 31, 3rd Ed., John Wiley & Sons, Inc. (1974), which is incorporated herein by reference. Preferably, the metals are nickel, cobalt, and copper.

The salt component of the metal salt may be any salt compound that aids and allows the dissolution of the metal portion in the bath solution. Such salts may include without limitation, sulfates, chlorides, acetates, phosphates, carbonates, and sulfamates.

The reducing agents are electron donors. When reacted with the free floating metal ions in the bath solution, the electroless reducing agents reduce the metal ions, which are electron acceptors, to metal for deposition onto the article. The use of a reducing agent avoids the need to provide an electrical current, as required in conventional electroplating. Common reducing agents are sodium hypophosphite, nickel hypophosphite, sodium borohydride, n-dimethylamineborane (DMAB), n-diethylamine borane (DEAB), formaldehyde, and hydrazine.

The particulate matter may be any suitable particle that is typically used in composite electroless plating. Preferably, such particulate matter is insoluble or sparingly soluble within the plating solution. It is also preferable that the particulate matter be inert and non-catalytic with respect to the deposition process. Particulate matter suitable for practical composite electroless plating may be from nanometers in size up to approximately 100 microns in size. The specific preferred size range depends on the application involved.

The particulate matter may be selected from a wide variety of distinct matter, such as ceramics, glass, talcum, plastics, diamond (polycrystaline or monocrystalline types), graphite, oxides, silicides, carbonate, carbides, sulfides, phosphate, boride, silicates, oxalates, nitrides, fluorides of various metals, as well. As metal or alloys of boron, tantalum, stainless steel, molybdenum, vanadium, zirconium, titanium and tungsten. Without limitation, preferred specific examples of particulate matter for use in the present invention are polytetrafluoroethylene (PTFE), diamond, silicon carbide, boron nitride (BN), aluminum oxide, graphite fluoride, tungsten carbide, talc, molybdenum disulfide ($MoS_2$), boron carbide, and graphite. The boron nitride (BN), without limitation, may be hexagonal or cubic in orientation. In the preferred embodiment, when PTFE particulate matter is introduced, it is of a concentration of 1 to 10 grams per liter and of an average particle size of 0.05 to 100 microns. In an alternative embodiment, the average particle size is about 0.2 microns.

As explained above, the particulate matter imparts one or more specific properties to the coating to be deposited. These properties including wear resistance, modified friction, release, lubrication, phosphorescence, thermal conduction, insulation, and others, depending upon the specific particulate matter utilized in the bath.

For example, for increased wear-resistance in the resultant coating, hard particulates, selected among diamond, carbides, oxides, and ceramics, may be included in the plating bath. Some examples of such carbides with wear resistant properties are silicon carbide, tungsten carbide, and boron carbide. An example of such an oxide is aluminum oxide.

For increased lubrication or reduction in friction in the resultant coating, "lubricating particles," such as but not limited to polytetrafluoroethylene (PTFE), boron nitride (BN), talc, molybdenum disulfide ($MOS_2$), graphite, or graphite fluoride may be included in the plating bath. These lubricating particles may embody a low coefficient of friction, dry lubrication, improved release properties, and repellency of contaminants such as water and oil.

The particulate matter stabilizer (PMS) refers to an additive that acts to increase inertness, change the Zeta potential or charge of the particles, or otherwise influence the interaction of the particles in the bath and their incorporation into the composite plated coating, and may also improve the stability of the bath which can be diminished by the addition of particulate matter to the bath. Any known PMS may be used in the composite electroless bath so long as its incorporation does not affect the basic kinetics of the plating process. Such particulate matter stabilizers (PMS) are well-known, and include, without limitation, sodium salts of polymerized alkyl naphthalene sulfonic acids, disodium mono ester succinate (anionic and nonionic groups), fluorinated alkyl polyoxyethylene ethanols, tallow trimethyl ammonium chloride, and any of the PMS disclosed in U.S. Pat. No. 6,306,466, which is incorporated herein by reference.

The electroless metallizing bath is essentially free of heavy metals, which means that the heavy metal concentration should be no more than 0.045 parts per million (ppm) or 45 parts per billion (ppb). Preferably, the heavy metal concentration should be no more than 0.03 ppm or 30 ppb.

Typically, toxic and/or heavy metals are added to conventional plating baths to brighten the resultant coating or to stabilize the bath, regardless of whether the bath contained particulate matter. As shown in the art, these materials stabilize the bath by preventing the bath's decomposition. Such materials may be, without limitation, lead, cadmium, and thallium.

The present invention also relates to composite plating baths, processes utilizing such baths, and the products produced by contacting with such baths where stabilizers other than traditional toxic and/or heavy metals are used in the bath. Such stabilizers can, without limitation, include non-heavy metals, metals that are not toxic, metals that are less toxic than the alloy produced by the bath without said metal stabilizer, metals that are less toxic than the other components of the bath, metals that are less toxic than the metal of the metal salt of the bath, non-metallic materials that provide a stabilizing effect, organic and/or inorganic materials that provide a stabilizing effect.

A heavy metal is defined as a metal of relatively high density (such as having a specific gravity greater than about 5 units) or of high relative atomic weight (especially one that is poisonous in small quantities, like mercury or lead), A toxic metal is defined as a metal that is not metabolized by the body, accumulates in the soft tissue, or is capable of causing injury or death. Some materials are defined to be toxic by regulatory agencies. From these definitions, one can see that certain metals may be considered heavy, but may or may not also be considered toxic. The converse is also true; metals may be toxic but not considered heavy.

Toxicity is also not an absolute quality of a material. A material in a particular quantity exhibits a level of toxicity. For example, the United States Department of Health and Human Services establishes annual lists of toxicity, by points and ranking, of various materials. Therefore it is practical to compare various materials based on their level of toxicity, and in industrial or commercial use it is preferable to utilize materials that are less toxic than others whenever possible. A key threshold to consider therefore is the selection of materials for stabilizers that are less toxic than the metal of the metal salt of the plating bath. Bismuth is one example of a metal that is considered heavy by the aforementioned definition, but is not considered by regulatory definition toxic.

The electroless metallizing bath may also contain one or more complexing agents. The complexing agent acts as a buffer to help control pH and maintain control over the "free" metal salt ions in the solution, all of which aids in sustaining a proper balance in the bath solution. Some of these complexing agents are, without limitation, lactic, malic, succinic, hydroxyacetic, acetic, ammonium compounds, and citric.

The electroless metallizing bath may further contain a pH adjuster to also help control pH levels in the bath. Suitable pH adjusters include, without limitation, carbonates, hydroxides, and acids that buffer at a desired pH range.

Once the bath has been prepared, it can be used in the electroless plating process of the present invention. This generally involves contacting the surface of an article with the electroless metallizing bath, which, as noted above, is essentially free of toxic and/or heavy metals.

However, the article to be coated may require preliminary preparation prior to this contact. This preparation includes the removal of surface contaminants.

The mechanism by which a coating is formed on an article in composite electroless plating is well known in the art. For example, U.S. Pat. No. 4,830,889, which is incorporated herein by reference, describes the electroless reaction mechanism. Generally, metal ions are reduced to metal by action of chemical reducing agents, which are electron donors. The metal ions are electron acceptors that react with the electron donors. The article to be coated itself may act as a catalyst for the reaction. The reduction reaction causes results in the deposition of a coating with the metal (or electroless metal) onto the surface of the article.

The article to be coated may be any substrate or material capable of being coated through composite electroless plating. Some examples of such articles are components in high wear, erosive, abrasive, impact, cutting, grinding, molding, frictional, and sliding applications.

Once completed, this electroless plating process results in an article with a coating containing metal or metal alloy and particulate matter. Importantly, the coating is essentially free of toxic and/or heavy metals resulting from the use of materials used for stabilizing the bath. For the coating to be essentially free of toxic and/or heavy metals resulting from the use of materials used for stabilizing the bath, the bath from which the plating took place should have been "essentially free" of toxic and/or heavy metals used for stabilizing the bath, as defined above. Notwithstanding, the coating should contain no more than 0.1% by weight of toxic and/or heavy metals and preferably, no more than 0.01% by weight of toxic and/or heavy metals resulting from the use of materials used for stabilizing the bath.

Generally, the electroless metal in the deposited coating is a metal or a metal alloy, usually in the form of a metal, a metal and phosphorous, or a metal and boron. The metal or metal alloy is derived from the metal salt used in the bath. Examples of the metal or metal alloy are nickel, nickel-phosphorous alloy, nickel-boron alloy, cobalt, cobalt-phosphorous alloy, and copper.

Specifically, "electroless" nickel is an alloy of about 88-99% nickel with the balance including phosphorous, boron, or possible other similar elements. Electroless nickel is commonly produced in one of four alloy ranges: low (1-4% P), medium (6-8% P), or high (10-12% P) phosphorous, and electroless nickel-boron with 0.5-3% B. Each variety of electroless nickel thus provides properties with varying degrees of hardness, corrosion resistance, magnetism, solder-ability, brightness, internal stress, and lubricity. All varieties of electroless nickel can be applied to numerous articles, including metals, alloys, and nonconductors.

Electroless nickel is produced by the chemical reaction of a nickel salt and a reducing agent. Typical electroless nickel baths also include one or more complexing agents, buffers, brighteners when desirable, and various stabilizers to regulate the speed of metal deposition and avoid decomposition of the solution that is inherently unstable. Such brighteners and stabilizers have traditionally been toxic and/or heavy metals, which were added in small but specific concentrations to the electroless nickel bath formulations. Cadmium is often used as a brightener while lead has been commonly used as a stabilizer used in electroless nickel baths since the inception of the technology. Diligent control of the solution's stabilizer content, pH, temperature, tank maintenance, loading, and freedom from contamination are essential to its reliable operation. Electroless nickel baths are highly surface area dependent. Surface areas in contact with the bath include the tank itself, in-tank equipment, immersed substrates, and contaminants. Continuous filtration, often submicron, of the solution at a rate of at least ten turnovers per hour is generally recommended to avoid particulate contamination which could lead to solution decomposition or imperfections in the plated layer.

The following examples demonstrate the electroless plating process of the present invention, in which different particulate matter and metals (or electroless metals) are plated onto articles. In addition, the examples show the potential for an increased plating rate for the composite electroless plating process of present invention, in which the plating bath is essentially free of toxic and/or heavy metal stabilizers, compared with conventional composite electroless plating processes, in which certain typical toxic and/or heavy metals are intentionally introduced into the plating bath as stabilizers.

The plating rate (i.e., the rate at which a plated coating deposits from the plating bath onto the article being plated) is measured by the thickness of coating achieved per unit of time. Microns or mils per hour are common measures of plating rate. As shown in the following examples, the plating rate was not shown to decrease due to the addition of particulate matter to an electroless plating bath. Instead, the plating rate of electroless metallizing coatings of the present invention show the potential for an increase over the standard plating rate of those same coatings of the conventional formulations in some instances. At the very least, the examples show that such plating without the intentional introduction of the conventional toxic and/or heavy metals results in successful deposition of a coating, an indication that the plating bath was stabilized without the use of the conventional toxic and/or heavy metals, and a plating rate that either matched the plating rate of plating with the intentional introduction of the conventional toxic and/or heavy metals or exceeded it. As a reference, the "standard plating rate" in the examples refers to the plating rates for conventional composite electroless plating for the particular coating deposited in each example, in which the bath used includes intentionally introduced the conventional toxic and/or heavy metals. For example, regarding a composite electroless nickel/PTFE bath that includes intentionally introduced the conventional toxic and/or heavy metals, the plating rate is commonly about 7.5 microns per hour.

EXAMPLE 1

Nickel-PTFE Without Toxic or Heavy Metals

A composite electroless nickel-PTFE bath was formulated. The bath included nickel salt providing a nickel metal concentration of 6 grams per liter in the plating bath, a reducing agent of sodium hypophosphite at a concentration of 30 grams per liter, an aqueous dispersion of PTFE particles and particulate matter stabilizers in a concentration of 3.6 grams of PTFE particles per liter of plating bath, and other components typical of electroless nickel baths, but free of any lead or other metals. The plating bath was operated at the parameters of pH 4.8-5.0, temperature of 90 degrees Celcius, and mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 120 minutes of plating in this plating bath the panel was removed from the immersion bath. The coating on the panel was analyzed as follows.

A photomicrograph of a cross section of this coating at 1000-× magnification demonstrated a coating thickness of 35 microns, i.e., 17.5 microns per hour which is 75% greater than the standard plating rate. Chemically dissolving the coating and weighing the PTFE incorporated in the coating compared to the weight and volume of the entire coating demonstrated 24-27% of PTFE by volume in the coating.

The above bath representing the present invention was maintained at the conditions and parameters above for the subsequent plating of additional steel panels until the plating bath reached a total usage of 2 metal turnovers during which the properties of the coating on these additional panels was consistent with the initial example, thereby demonstrating that the present invention is reproducible and commercially viable.

COMPARATIVE EXAMPLE 1

Nickel-PTFE With Heavy Metals

A composite electroless nickel-PTFE bath with intentionally introduced heavy metals was formulated. The one-liter bath, commercially known as NiSlip™ 510, sold by Surface Technology, Inc. of Trenton, N.J., was prepared according to the manufacturer's specifications. This plating bath included nickel salt providing a nickel metal concentration of 6 grams per liter in the plating bath, a reducing agent of sodium hypophosphite at a concentration of 30 grams per liter, an aqueous dispersion of PTFE particles and particulate matter stabilizers in a concentration of 3.6 grams of PTFE particles per liter of plating bath, lead in a concentration of 1 ppm, and other components typical of electroless nickel baths. The plating bath was operated according to the manufacturer's prescribed parameters of pH 4.8-5.0, temperature of 190-90 degrees Celcius, with mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath at the parameters disclosed above. After 120 minutes of immersion in this plating bath the panel was removed from the plating bath. The coating on the panel was analyzed as follows.

A photomicrograph of a cross section of this coating at 1000-× magnification demonstrated a coating thickness of 20 microns, i.e.: 10 microns per hour, which is the standard plating rate. Chemically dissolving the coating and weighing the PTFE incorporated in the coating compared to the weight and volume of the entire coating demonstrated 24-27% of PTFE by volume in the coating. This is also a standard concentration of PTFE for such a coating.

EXAMPLE 2

Nickel-Diamond Without Toxic or Heavy Metals

A composite electroless nickel-diamond bath was formulated. The bath included nickel salt providing a nickel metal concentration of 6 grams per liter in the plating bath, a reducing agent of sodium hypophosphite at a concentration of 30 grams per liter, an aqueous dispersion of diamond particles and particulate matter stabilizers in a concentration of 6 grams per liter, and other components typical of electroless nickel baths, but free of any lead or other metals. The plating bath was operated at the parameters of pH 4.8-4.9, temperature of 90 degrees Celcius, and mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 60 minutes of plating in this plating bath the panel was removed from the plating bath. The coating on the panel was analyzed as follows.

A photograph of a cross section of this coating at 1000-× magnification demonstrated a coating thickness of 14-15 microns, i.e.: 14-15 microns per hour, which is equivalent to the standard plating rate. Chemically dissolving the coating and weighing the diamond incorporated in the coating compared to the weight and volume of the entire coating demonstrated 15% of diamond by volume in the coating.

The above bath representing the present invention was maintained at the conditions and parameters above for the subsequent plating of additional steel panels until the plating bath reached a total usage of 2 metal turnovers during which the properties of the coating on these additional panels was consistent with the initial example, thereby demonstrating that the present invention is reproducible and commercially viable.

EXAMPLE 3

Nickel-Aluminum Oxide Without Toxic or Heavy Metals

A composite electroless nickel-aluminum oxide bath was formulated. The bath included nickel salt providing a nickel metal concentration of 6 grams per liter in the plating bath, a reducing agent of sodium hypophosphite at a concentration of 30 grams per liter, an aqueous dispersion of aluminum oxide particles and particulate matter stabilizers in a concentration of 3.5 grams of particles per liter, and other components typical of electroless nickel baths, but free of any lead or other metals. The plating bath was operated at the parameters of pH 4.8-4.9, temperature of 90 degrees Celcius, and mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 120 minutes of plating in this plating bath the panel was removed from the plating bath. The coating on the panel was analyzed as follows.

A photomicrograph of a cross section of this coating at 1000-× magnification demonstrated a coating thickness of 40-45 microns, i.e.: 20-22.5 microns per hour, which is equivalent to the standard plating rate. The photomicrograph also demonstrated a uniform dispersion of particles within the metal alloy matrix.

EXAMPLE 4

Nickel-Boron Nitride Without Toxic or Heavy Metals

A composite electroless nickel-boron nitride bath was formulated. The bath included nickel salt providing a nickel metal concentration of 6 grams per liter in the plating bath, a reducing agent of sodium hypophosphite at a concentration of 30 grams per liter, an aqueous dispersion of boron nitride particles and particulate matter stabilizers in a concentration of 10 grams of particles per liter, and other components typical of electroless nickel baths, but free of any lead or other metals. The plating bath was operated at the parameters of pH 4.8-4.9, temperature of 90 degrees Celcius, and mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 120 minutes of immersion in this plating bath the panel was removed from the plating bath. The coating on the panel was analyzed as follows.

A photograph of a cross section of this coating at 1000-× magnification demonstrated a coating thickness of 45-50 microns, i.e.: 22.5-25 microns per hour, which is somewhat faster than the standard plating rate. The photomicrograph also demonstrated a uniform dispersion of particles within the metal alloy matrix.

EXAMPLE 5

Nickel-Silicon Carbide Without Toxic or Heavy Metals

A composite electroless nickel-silicon carbide bath was formulated. The bath included nickel salt providing a nickel metal concentration of 6 grams per liter in the plating bath, a reducing agent of sodium hypophosphite at a concentration of 30 grams per liter, an aqueous dispersion of silicon carbide particles and particulate matter stabilizers in a concentration of 3.5 grams per liter, and other components typical of electroless nickel baths, but free of any lead or other metals. The plating bath was operated at the parameters of pH 4.8-4.9, temperature of 90 degrees Celcius, with mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 120 minutes of immersion in this plating bath the panel was removed from the plating bath. The coating on the panel was analyzed as follows.

A photograph of a cross section of this coating at 1000-× magnification demonstrated a coating thickness of 45-50 microns, i.e.: 22.5-25 microns per hour, which is somewhat faster than the standard plating rate. The photomicrograph also demonstrated a uniform dispersion of particles within the metal alloy matrix.

EXAMPLE 6

Nickel-Boron Carbide Without Toxic or Heavy Metals

A composite electroless nickel-boron carbide bath was formulated. The bath included nickel salt providing a nickel metal concentration of 6 grams per liter in the plating bath, a reducing agent of sodium hypophosphite at a concentration of 30 grams per liter, an aqueous dispersion of boron carbide particles and particulate matter stabilizers in a concentration of 3.5 grams of particles per liter, and other components typical of electroless nickel baths, but free of any lead or other metals. The plating bath was operated at the parameters of pH 4.8-4.9, temperature of 90 degrees Celcius, with mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 120 minutes of immersion in this plating bath the panel was removed from the plating bath. The coating on the panel was analyzed as follows.

A photograph of a cross section of this coating at 1000-× magnification demonstrated a coating thickness of 50-60 microns, i.e.: 25-30 microns per hour, which is somewhat faster than a standard plating rate of the prior art. The photomicrograph also demonstrated a uniform dispersion of particles within the metal alloy matrix.

EXAMPLE 7

Nickel-Tungsten Carbide Without Toxic or Heavy Metals

A composite electroless nickel-tungsten carbide bath was formulated. The bath included nickel salt providing a nickel metal concentration of 6 grams per liter in the plating bath, a reducing agent of sodium hypophosphite at a concentration of 30 grams per liter, an aqueous dispersion of tungsten carbide particles and particulate matter stabilizers in a concentration of 3.5 grams per liter, and other components typical of electroless nickel baths, but free of any lead or other metals. The plating bath was operated at the parameters of pH 4.8-4.9, temperature of 90 degrees Celcius, with mild stirring agitation.

A steel panel measuring 2 cm by 5 cm was prepared by an immersion in a hot (180 degrees Fahrenheit) alkaline cleaning solution for 10 minutes, rinsed in water, immersion in a fifty percent by volume concentration of hydrochloric acid in water at 70 degrees Fahrenheit for 1 minute, rinsed in water, and then immersed in the plating bath of the present invention at the parameters disclosed above. After 90 minutes of immersion in this plating bath the panel was removed from the plating bath. The coating on the panel was analyzed as follows.

A photograph of a cross section of this coating at 1000-× magnification demonstrated a coating thickness of 100 microns, i.e.: 66 microns per hour, which is fast compared to the standard plating rate. The photomicrograph also demonstrated a uniform dispersion of particles within the metal alloy matrix.

EXAMPLE 8

Nickel-Graphite Fluoride Without Toxic or Heavy Metals

A composite electroless nickel-graphite fluoride bath was formulated. The bath included nickel salt providing a nickel metal concentration of 6 grams per liter in the plating bath, a reducing agent of sodium hypophosphite at a concentration of 30 grams per liter, an aqueous dispersion of graphite fluoride particles and particulate matter stabilizers in a concentration of 3.5 grams of particles per liter, and other components typical of electroless nickel baths, but free of any lead or other metals. The plating bath was operated at the parameters of pH 4.8-4.9, temperature of 90 degrees Celcius, with mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 60 minutes of immersion in this plating bath the panel was removed from the plating bath. The coating on the panel was analyzed as follows.

A photograph of a cross section of this coating at 1000-× magnification demonstrated a coating thickness of 25-30 microns, i.e.: 12.5-15 microns per hour, which is equivalent to the standard plating rate. The photomicrograph also demonstrated a uniform dispersion of particles within the metal alloy matrix.

EXAMPLE 9

Cobalt/Boron-Diamond Without Toxic or Heavy Metals

A composite electroless cobalt/boron-diamond bath was formulated. The bath included cobalt salt providing a cobalt metal concentration of 7.5 grams per liter in the plating bath, a reducing agent of DMAB at a concentration of 2.5 grams per liter, an aqueous dispersion of diamond particles and particulate matter stabilizers in a concentration of 3.5 grams of particles per liter, and other components typical of electroless baths, but free of any lead or other metals. The plating bath was operated at the parameters of pH 6.0-6.3, temperature of 55 degrees Celcius, with mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 240 minutes of immersion in this plating bath the panel was removed from the plating bath. The coating on the panel was analyzed as follows.

A photograph of a cross section of this coating at 1000-× magnification demonstrated a coating thickness of about 20 microns, i.e.: about 4-5 microns per hour, which is equivalent to the standard plating rate. The photomicrograph also demonstrated a uniform dispersion of particles within the metal alloy matrix.

EXAMPLE 10

Cobalt/Phosphorous-Diamond Without Toxic or Heavy Metals

A composite electroless cobalt/phosphorous-diamond bath was formulated. The bath included cobalt salt providing a cobalt metal concentration of 7.5 grams per liter in the plating bath, a reducing agent of sodium hypophosphite at a concentration of 25 grams per liter, an aqueous dispersion of diamond particles and particulate matter stabilizers in a concentration of 3.5 grams of particles per liter, and other components typical of electroless baths, but free of any lead or heavy metals. The plating bath was operated at the parameters of pH 9.5-10, temperature of 90 degrees Celcius, with mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 180 minutes of immersion in this plating bath the panel was removed from the plating bath. The coating on the panel was analyzed as follows.

A photograph of a cross section of this coating at 1000-× magnification demonstrated a coating thickness of about 21 microns, i.e.: about 7 microns per hour, which is equivalent to a standard plating rate. The photomicrograph also demonstrated a uniform dispersion of particles within the metal alloy matrix.

EXAMPLE 11

Nickel-Silicon Carbide Without Heavy Metals

A composite electroless nickel-silicon carbide bath was formulated. The bath included nickel salt providing a nickel metal concentration of 6 grams per liter in the plating bath, a reducing agent of sodium hypophosphite at a concentration of 30 grams per liter, an aqueous dispersion of silicon carbide particles and particulate matter stabilizers in a concentration of 3.5 grams per liter, and other components typical of electroless nickel baths, but including bismuth (a non-toxic heavy metal) and not including lead or any other metal. The plating bath was operated at the parameters of pH 4.8-4.9, temperature of 90 degrees Celcius, with mild stirring agitation.

A steel panel measuring 2 cm by 5 cm was prepared by an immersion in a hot (180 degrees Fahrenheit) alkaline cleaning solution for 10 minutes, rinsed in water, immersed in a fifty percent by volume concentration of hydrochloric acid in water at 70 degrees Fahrenheit for 1 minute, rinsed in water, and then immersed in the plating bath of the present invention at the parameters disclosed above. After 60 minutes of immersion in this plating bath the panel was removed from the plating bath. The coating on the panel was analyzed as follows.

A photograph of a cross section of this coating at 1000-× magnification demonstrated a coating thickness of 24 microns, i.e.: 24 microns per hour, which is somewhat faster than the standard plating rate. The photomicrograph also demonstrated a uniform dispersion of particles within the metal alloy matrix.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An electroless metalizing bath comprising an aqueous solution of a metal salt, a reducing agent, and particulate matter;

wherein said electroless metalized bath is essentially free of lead.

2. The electroless metalizing bath of claim 1, wherein said particulate matter is selected from a group consisting of diamond, silicon carbide, boron nitride (BN), aluminum oxide, graphite fluoride, tungsten carbide, talc, molybdenum disulfide ($MoS_2$), boron carbide, graphite, lubricating materials, wear resistant materials, and phosphorescent materials.

3. The electroless metalizing bath of claim 1, wherein said aqueous bath is essentially free of other heavy metals.

4. The electroless metalizing bath of claim 1, wherein said aqueous bath is essentially free of other toxic metals.

5. The electroless metalizing bath of claim 1, wherein said particulate matter includes PTFE.

6. The electroless metalizing bath of claim 5, wherein said bath is adapted for plating an article at a rate of at least 10 microns per hour.

7. The electroless metalizing bath of claim 1, wherein said bath further includes a particulate matter stabilizer.

8. The electroless metalizing bath of claim 1, wherein said bath further includes a complexing agent.

9. The electroless metalizing bath of claim 1, wherein when said bath is adapted for plating an article, the resulting plating on said article is consistent with ELV or RoHS regulations.

10. The electroless metalizing bath of claim 1, wherein when said bath is adapted for plating an article, the resulting plating on said article is compliant with regulatory criteria for end of life disposal.

11. An electroless metalizing bath comprising an aqueous solution of a metal salt, a reducing agent, and particulate matter;

wherein said electroless metalized bath is essentially free of cadmium.

12. The electroless metalizing bath of claim 11, wherein said particulate matter is selected from a group consisting of diamond, silicon carbide, boron nitride (BN), aluminum oxide, graphite fluoride, tungsten carbide, talc, molybdenum disulfide ($MoS_2$), boron carbide, graphite, lubricating materials, wear resistant materials, and phosphorescent materials.

13. The electroless metalizing bath of claim 11, wherein said bath is essentially free of other heavy metals.

14. The electroless metalizing bath of claim 11, wherein said bath is essentially free of other toxic metals.

15. The electroless metalizing bath of claim 11, wherein said particulate matter includes PTFE.

16. The electroless metalizing bath of claim 15, wherein said bath is adapted for plating an article at a rate of at least 10 microns per hour.

17. The electroless metalizing bath of claim 11, wherein said aqueous bath further includes a particulate matter stabilizer.

18. The electroless metalizing bath of claim 11, wherein said aqueous bath further includes a complexing agent.

19. The electroless metalizing bath of claim 11, wherein when said bath is adapted for plating an article, the resulting plating on said article is consistent with ELV or RoHS regulations.

20. The electroless metalizing bath of claim 11, wherein when said bath is adapted for plating an article, the resulting plating on said article is compliant with regulatory criteria for end of life disposal.

* * * * *